United States Patent [19]

Ekkelboom et al.

[11] 4,002,940

[45] Jan. 11, 1977

[54] ELECTRODE FOR A DISCHARGE LAMP

[75] Inventors: Tjepke Hendrik Ekkelboom; Antonius Johannes Alberta van Stratum, both of Eindhoven, Netherlands

[73] Assignee: U. S. Philips Corporation, New York, N.Y.

[22] Filed: June 6, 1975

[21] Appl. No.: 584,614

[30] Foreign Application Priority Data

June 12, 1974 Netherlands ..... 7407813

[52] U.S. Cl. ..... 313/346 R; 29/25.17; 313/218; 313/350; 313/352; 252/500; 252/516

[51] Int. Cl.[2] ..... H01J 1/14; H01J 19/06

[58] Field of Search ..... 313/218, 219, 346, 352, 313/350; 29/25.17; 252/500, 516

[56] References Cited

UNITED STATES PATENTS

| | | | |
|---|---|---|---|
| 2,725,498 | 11/1955 | Storms et al. | 313/217 |
| 3,590,242 | 6/1971 | Glascock | 313/346 |

*Primary Examiner*—Saxfield Chatmon, Jr.
*Attorney, Agent, or Firm*—Frank R. Trifari; Robert S. Smith

[57] ABSTRACT

Electrodes for a discharge lamp having a semispherical fused body to produce a very stable arc.

The electrodes can be manufactured inter alia by compressing a mixture of tungsten powder, metal carbide powder and a binder to a moulding, sintering the moulding, and fusing it then at least partly in a discharge arc, the sintered moulding serving as one of the electrodes.

15 Claims, 13 Drawing Figures

ELECTRODE FOR A DISCHARGE LAMP

The invention relates to discharge lamps and particularly to electrodes for such lamps. The invention also relates to methods of manufacturing discharge lamps having such electrodes.

United Kingdom patent specification 1,240,778 describes a high pressure compact arc lamp which has electrodes having a sintered head of 20 to 90 % by weight of tantalum carbide and 80 to 10 % by weight of tungsten. The electrode head is secured to an electrode pin by a shrink fitting around which pin a tungsten wire having an emitter is coiled.

This known electrode has an electrode head having a cylindrical base and a, possibly truncated, cone as a top.

It has been found that this electrode produces a non-stable arc. In the head of the electrode, areas occur having higher temperatures where the discharge is concentrated. At those areas, small balls of the electrode material are formed on the electrode surface. They serve alternatively as preferred areas where the arc attacks.

Another drawback of using the known electrode is that the electrode spacing during operations becomes larger.

It is the object of the invention to provide electrodes which produce a stable diffusely attacking arc and which, when incorporated in a discharge lamp, furthermore ensure a constant electrode spacing.

It has been found that these objects are realized with electrodes of the kind mentioned in the preamble which are characterized in that the electrode head is an at least semi-spherical fusing body of 20 – 80 % by weight of tungsten, 80 – 20 % by weight of a metal carbide chosen from the group consisting of tantalum carbide, hafnium carbide and zirconium carbide, and 0 – 5 % by weight calculated on these two components of a metal chosen from the group consisting of thorium and uranium, in elementary form or as a boride, a carbide or an oxide.

Since the part of the electrode according to the invention (the fusing body) destined for attack by starting the discharge arc is uniformly curved and consists of alloyed material, the formation of the places of higher temperature varying with time is excluded. The attacking point of the discharge arc is now the place where the spacing between the electrodes is smallest.

It is to be noted that the said United Kingdom patent specification states that the electrode described therein during operation has a melted spot where the arc attacks.

However, the electrode therein is essentially different from the electrode according to the invention, since the known electrode, after having been in operation, is melted only locally, superficially, just as a result of the occurrence of places having a higher temperature, which the invention aims to avoid.

In those embodiments of the electrode in which the electrode head comprises a thorium or uranium emitter, coils having emitter around the electrode pin may be omitted.

The electrode head may approach more or less the shape of a sphere, provided it has at least half a sphere.

The electrode according to the invention will be described in greater detail with reference to the drawings.

FIGS. 1 to 5 are longitudinal sectional views through electrodes.

In FIG. 1, reference numeral 1 denotes an electrode head connected to the electrode pin 2 of tungsten by fusion.

In FIG. 2, reference numeral 3 denotes an electrode head which is connected to a sintered electrode pin 4 of the same composition as the electrode head by fusion.

In FIG. 3, reference numeral 5 denotes an electrode head which is connected to a sintered electrode pin 6 by fusion. The pin 6 is connected to a tungsten supporting pin 8 at 7 by a shrink fitting.

In FIG. 4, reference numeral 9 denotes an electrode head connected to a sintered pin 10 by fusion. The electrode pin is connected to a tungsten supporting pin 12 by means of a wound tungsten wire 11.

In FIG. 5, reference numeral 13 denotes an electrode head which is connected to a tungsten electrode pin by fusion. 14 denotes an annular zone of metal carbide which is connected both to the electrode head 10 and to the pin 15 by fusion. Said zone may contain in addition uranium, thorium, the carbide, oxide or boride thereof, and tungsten.

Instead of tungsten electrode pins and supporting pins, pins of tungsten and thorium oxide may also be used. However, pure tungsten gives excellent satisfaction.

In a preferred embodiment the electrode head comprises metal carbide and tungsten in the weight ratio 3:2 due to the particular stability of the discharge arc and the electrode with this composition.

As a rule the electrode heads have a diameter of 1–3 mm, the electrode pins have a thickness of 0.7 – 3 mm.

The electrodes are particularly suitable for use in high pressure mercury lamps which may be provided with halides, high pressure sodium lamps and for high pressure compact arc lamps both in alternating current and direct current constructions.

Another aspect of the invention relates to the manufacture of the new electrode. It has been found that electrodes of a very good quality can be obtained by granulating the compounds of which the electrode consists while mixed with a binder, compressing the granulate to mouldings and fusing these at least locally after sintering.

The invention also relates to a method of manufacturing electrodes for discharge lamps in which tungsten powder and a metal carbide powder are mixed with a binder, the mixture is compressed in a mould and the moulding is sintered in a protective gas, characterized in that a powder mixture of tungsten, a metal carbide chosen from the group consisting of tantalum carbide, hafnium carbide and zirconium carbide and a metal chosen from the group consisting of thorium and uranium, in elementary form or as a boride, a carbide or an oxide in such a mixing ratio that the resulting electrode head contains 20 – 80 % by weight of tungsten, 80 – 20 % by weight of the metal carbide and 0 – 5 % by weight of the metal calculated on tungsten and metal carbide, is granulated with a binder, the granulate is compressed in a mould at a pressure of at least 2000 kg/cm$^2$ and the moulding, after sintering, is heated in an arc discharge in an inert atmosphere during which the moulding serves as one of the electrodes, for such a period of time that at least a part of the moulding is melted and has assumed the shape of at least half a sphere.

The moulding may have a variety of shapes. In general, however, it will be in the form of a rod having a circular or square cross-section. The moulding may have a recess in one end face for connection to a supporting pin.

In a special embodiment the moulding is in the form of a disc and it is destined to be fused entirely to an electrode head. In this embodiment also the moulding may have a continuous or non-continuous cavity for connection to an electrode pin.

In a variation of the method the sintering is interrupted so as to provide in the moulding a recess for assembly to the electrode pin or supporting pin. This may be carried out by drilling or by means of ultrasonic vibrations.

In the case in which the moulding is in the form of a disc which, placed on a tungsten electrode pin, is melted to form an electrode head, the top of the electrode pin also melts and the tungsten originating therefrom fuses with the remaining melted material so that the tungsten content thereof increases. The extent to which this happens depends on the length and the thickness of the part of the electrode pin which extends in the moulding.

With a given geometry of the electrode pin the composition of the moulding necessary to obtain an electrode head having a desired composition can be established empirically.

The compressed mouldings are sintered in an inert atmosphere, for example, hydrogen, until a temperature of approximately 2300° C is reached. This operation may be used to place an electrode pin having a recess at one end on a tungsten supporting pin and causing it to fit on it by shrinkage. It is also possible in a comparable manner to shrink a disc-shaped moulding on a tungsten electrode pin.

The sintered body is caused to melt at least partly in an arc discharge. This operation is carried out in an inert gas atmosphere, for example, in helium, argon, xenon or neon. Said operation is preferably carried out so that a vertical arc is formed between the sintered body as the lower electrode and an upper electrode of, for example, tungsten.

According as the arc discharge with sufficiently high power is maintained longer, more material will melt. Under the influence of its surface tension the melt assumes a spherical shape which approaches the shape of a sphere more and more according as more material has melted.

The melting of the moulding may take place both in an a.c. discharge arc and in an d.c. discharge arc. In the latter case the moulding serves as the anode. The electrodes are connected to a current source of at least 90 volts. The discharge current is preferably maintained constant during the melting process.

As a binder for preparing the granulate several agents may be used, in particular polyacrylates and polymethacrylates, for example, polyethylacrylate. The quantity of binder used is little critical. Excellent results are obtained already with 1 % by weight calculated on the powder mixture to be bound, but a multiple of said quantity may also be used. As a rule, 1 – 5 % by weight is used.

The invention also relates to a method of manufacturing electrodes of tungsten and a metal carbide for discharge lamps, which method is characterized in that a tungsten pin is coated near one end with a mixture of (a) powdered tantalum carbide, zirconium carbide, hafnium carbide, tantalum/carbon 1 : 1, hafnium/carbon 1 : 1 or zirconium/carbon 1 : 1 (gr. at), (b) a powdered metal chosen from the group consisting of uranium and thorium in elementary form or as an oxide, a boride or a carbide, and (c) a binder in a volatile diluent, after which, after evaporation of the diluent, heating is carried out in an inert atmosphere in an electric arc discharge which attacks at the end face of the tungsten pin present near the coating and which is maintained for such a long time that the end of the pin and the coating are melted and have assumed a shape of at least half a sphere, the quantity of (a) and (b) being such that the fused top of the pin has a composition of 20 – 80 % by weight of tungsten, 80 – 20 % by weight of a metal carbide chosen from the group consisting of tantalum carbide, hafnium carbide and zirconium carbide, and 0 – 5 % by weight calculated on tungsten and the carbide of a metal chosen from the group consisting of thorium and uranium in an elementary form, as an oxide, a boride or a carbide.

In a variation of this method, the coating mixture is made to contain in addition up to 5 % by weight of tungsten powder calculated on component (a).

The melting operation may be carried out as described above.

Various binders may be used in the method, for example, cellulose binders, for example, nitrocellulose. As diluents may be used volatile compounds, for example, ethyl acetate, butyl acetate or amyl acetate. With binder and diluent a pasty substance is made of the ingredients (a) and (b). In general up to 5 % by weight of the binder is used.

Since the paste need not contain any tungsten, since the tungsten component in the electrode manufactured according to said method may originate entirely from the tungsten pin, the quantity of uranium or thorium (compound) in the paste may be higher than in the alloyed spherical part of the electrode head. The part of the electrode head which is denoted by 14 in FIG. 5 and which contains comparatively little tungsten may therefore comprise relatively such uranium or thorium (compound). This has proved to have no detrimental effect whatsoever on the stability of the electrode or of the discharge arc attacking on the spherical top of the electrode.

The methods according to the invention may be described in greater detail with reference to FIGS. 6 to 11 and the ensuing specific examples.

FIGS. 6, 7 and 9 longitudinal cross-sectional views through mouldings obtained by compressing a mixture of tungsten powder, metal carbide powder and binder.

EXAMPLE 1

Figure 6:
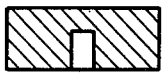
Figure 7:
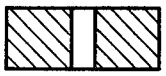
Figure 8:
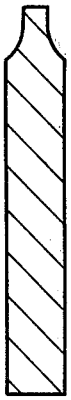
FIGS. 8 and 10 are longitudinal cross-sectional views through a tungsten electrode pin and a tungsten supporting pin, respectively.
Figure 9:
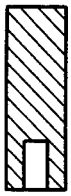
Figure 10:
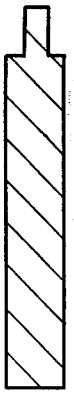

40 parts by weight of tungsten powder and 60 parts by weight of tantalum carbide powder were mixed with 2 parts by weight of a 46% by weight dispersion of polyethyl-acrylate in water. After a homogeneous mixture had been obtained, it was stored until it was dry. The mass was then fractured and the granules of 60 – 200 $\mu$m size were separated by sieving. They were supplied to a matrix in which they were compressed to a disc-shaped moulding having a diameter of 2.5 mm and a thickness of 1 mm at a pressure of 2000 kg/cm$^2$ (FIG. 6). The moulding was placed on a tungsten electrode pin of 1 mm diameter (FIG. 8) after which the assembly was heated to 600° C within 5 minutes. After the temperature had been kept constant for 5 minutes, the temperature was increased to 2300° C, which temperature was maintained for 15 minutes. The whole thermal treatment was carried out in a hydrogen atmosphere.

Figure 1:
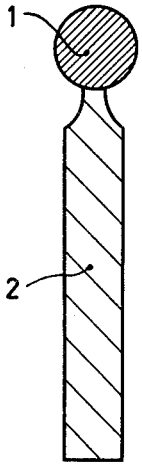
Figure 2:
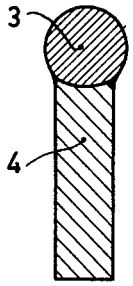

The tungsten pin with the moulding shrunk thereon was arranged vertically at a distance of 2 mm below a tungsten electrode. The pin and the electrode were connected to a 90 volts alternating current source. An arc discharge was then used between the two in an argon atmosphere. The discharge current was maintained until the head of the lower electrode had become substantially spherical (FIG. 1).

EXAMPLE 2

30 parts by weight of tungsten powder, 70 parts by weight of hafnium carbide powder and 3 parts by weight of thorium carbide powder were mixed with 4 parts by weight of a 46% dispersion of the polyethylacrylate in water. After drying, the mixture was granulated to particles of 60 to 300 $\mu$m and then compressed in a matrix at a pressure of 10,000 kg/cm$^2$ to form a circular disc of 1.5 mm diameter and 1.5 mm thickness. The disc was heated to 700° C within 5 minutes and, after having been kept at that temperature for 5 minutes, it was further heated to 1500° C, which temperature was maintained for 10 minutes. A hole of 0.4 mm was then drilled in the centre of the disc and the disc was provided on a 1 mm diameter tungsten pin tapering at one end. The assembly was then heated to 2300° C for 15 minutes. All thermal treatments were carried out in hydrogen.

The sintered disc was then fused with the tungsten pin in the same manner as described in Example 1 with the difference that in this case a direct current discharge arc was used and the electrode to be formed served as an anode.

EXAMPLE 3

Figure 3:
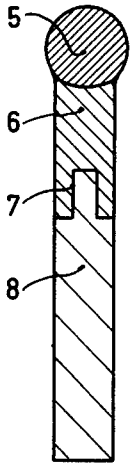
Figure 4:
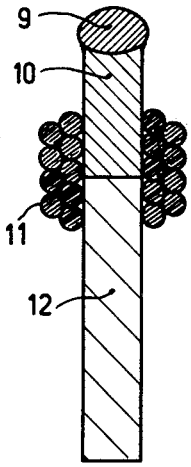

50 parts by weight of tungsten powder, 50 parts by weight of tantalum carbide powder and 5 parts by weight of thorium oxide powder were mixed with 2 parts by weight of a 46% polyethylacrylate dispersion in water. After drying, the mixture was granulated to particles having a size of 60 to 200 $\mu$m and were then compressed under a pressure of 3000 kg/cm$^2$ to form a cylindrical rod of 1 mm diameter and 3 mm length having a recess at one end face. The resulting moulding was placed on a tungsten supporting pin tapering at one end, after which the compressed moulding was sintered and then partly melted as described in example 1 until a substantially-spherical electrode head had been obtained (FIG. 3).

EXAMPLE 4

Figure 11:
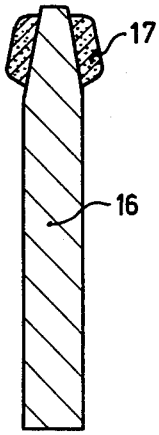
FIG. 11 is a longitudinal cross-sectional view through a tungsten electrode pin 16 having a coating of TaC 17.

Tantalum carbide powder was mixed with 4% by weight of nitrocellulose and butylacetate to form a pasty substance. A tungsten pin of 1 mm diameter of which one end had been ground to form a straight truncated cone was covered at the ground end with the paste over a length of 1.5 mm. The thickness of the provided layer was equal to half the average diameter of the covered part of the pin. The end face of the pin was not covered with paste (FIG. 11).

Figure 5:
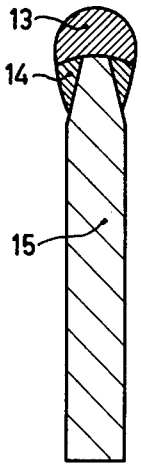

The pin was placed in a vertical position with the coated end uppermost. Between the pin and a tungsten pin arranged above it, an alternating current arc discharge was produced in a helium atmosphere. The potential difference across the electrode was 18 volts. The arc discharge was maintained until a more than semispherical head of fused tungsten and tantalum carbide had formed on the lower electrode (FIG. 5).

The invention also relates to electric discharge lamps having one or more electrodes according to the invention.

Figure 12:
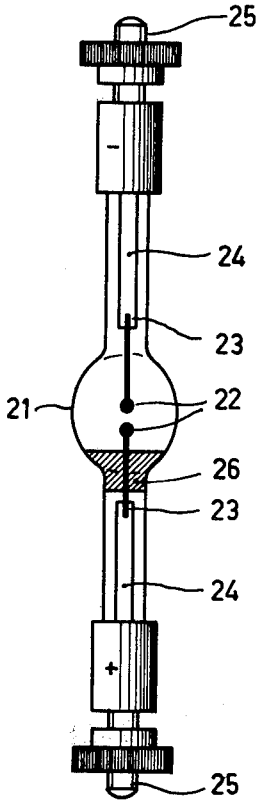

FIG. 12 shows a compact arc mercury discharge lamp.

Figure 13:
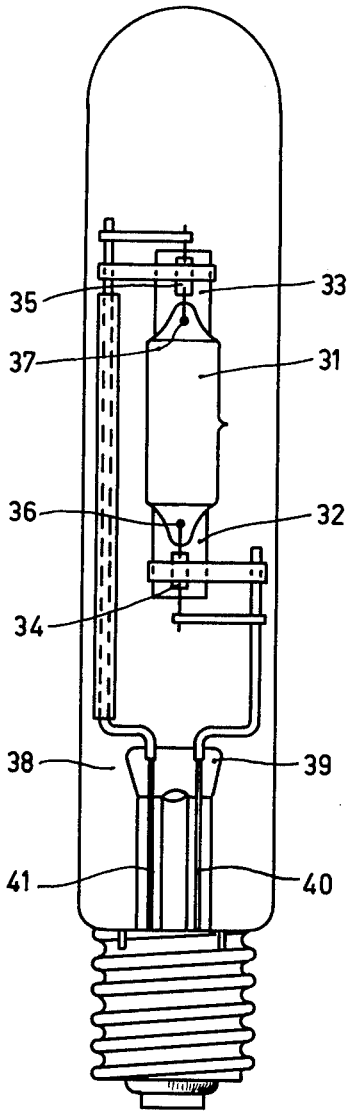

FIG. 13 shows a high pressure mercury discharge lamp.

Reference numeral 21 in FIG. 12 denotes a quartz glass discharge vessel having xenon as a filling gas. 22 denotes substantially spherical electrode heads consisting of alloyed tungsten, tantalum carbide and thorium oxide. The heads 22 are connected to electrode pins 23 of tungsten by fusion which pins are led through to the exterior in a vacuum-tight manner via molybdenum foils 24 which are connected to the current supply conductors 25. 26 denotes a coating reflecting thermal radiation. The lamp is operated with direct current and during operation consumes a power of approximately 200 Watts.

In FIG. 13, reference numeral 31 denotes the quartz glass discharge vessel of a lamp according to the invention which during operation consumes a power of approximately 400 Watts. At either end of the vessel 31 pinches 32 and 33, respectively, are formed in which current supply elements 34 and 35 are sealed. These current supply elements are connected inside the discharge vessel to electrodes 36 and 37 between which the discharge takes place during operation. The discharge vessel 31 is placed in an evacuated or inert-gas-filled outer envelope 38, for example of hard glass, which has a pinch 39 at one end through which current supply wires 40 and 41 are led through in a vacuum-tight manner. The current supply wires 40 and 41 are connected to the current supply elements 34 and 35 and also serve as supporting poles for the discharge vessel.

What is claimed is:

1. A discharge lamp which comprises: an envelope and at least two electrodes, each electrode including a head and a supporting pin, said head being at least a semispherical fused body 20–80% by weight of tungsten, 80–20% by weight of a metal carbide chosen from the group consisting of tantalum carbide, hafnium carbide and zirconium carbide, and 0–5% of a third substance, the quantity of said third substance being determined by weight in relation to the total weight of said tungsten and said metal carbide, said third substance being chosen from the group consisting of elementary thorium, elementary uranium, and the borides, carbides and oxides of thorium and uranium.

2. Apparatus as claimed in claim 1, characterized in that the electrode head is connected to a tungsten electrode pin by fusion.

3. Apparatus as claimed in claim 1, characterized in that the electrode head is connected to a sintered electrode pin having the same composition as the electrode head by fusion.

4. Apparatus as claimed in claim 2, characterized in that the electrode head is spherical.

5. Apparatus as claimed in claim 3, characterized in that the electrode pin is connected to a tungsten supporting pin by a shrink fitting.

6. Apparatus as claimed in claim 2, characterized in that the electrode has an annular zone which is secured by fusion to the electrode pin and to the side of the electrode head facing the electrode pin, which zone varies with a decreasing thickness when the distance from the electrode head increases and consists of an alloyed metal carbide chosen from the group consisting of tantalum carbide, hafnium carbide and zirconium carbide with 0–25 % by weight calculated on the metal carbide of a metal chosen from the group consisting of thorium and uranium as an element, as a boride, an oxide or a carbide and 0–5% by weight of tungsten calculated on the metal carbide.

7. A method of manufacturing an electrode for discharge lamps which comprises: mixing tungsten powder and a metal carbide powder with a binder, compressing the mixture in a mould to form a moulding and sintering the moulding in a protective gas, said powder comprising a mixture of tungsten, a metal carbide chosen from the group consisting of tantalum carbide, hafnium carbide and zirconium carbide and a metal chosen from the group consisting of elementary thorium, elementary uranium and the borides, carbides and oxides thereof, the composition of an electrode head being 20–80% by weight of tungsten, 80–20% by weight of said metal carbide and 0–5% of a third substance, the weight of said third substance being determined in relation to the total weight of said tungsten and said metal carbide by weight of the metal calculated on tungsten and the metal carbide, is granulated with a binder, the granulate is compressed in a mould at a pressure of at least 2000 kg/cm$^2$ and the moulding, after sintering, is heated in an arc discharge in an inert atmosphere during which the moulding serves as one of the electrodes, for such a period of time that at least a part of the moulding is melted and has assumed the shape of at least a semisphere.

8. A method as claimed in claim 7, wherein said moulding includes a recess and during said sintering step said moulding is shrunk on a tungsten pin which is inserted in said recess.

9. A method as claimed in claim 7 said heating step is accomplished with a vertical discharge arc, with the moulding serving as the lower electrode.

10. A method as claimed in claim 7 wherein said binder is a polyacrylate or polymethacrylate.

11. A method as claimed in claim 10, wherein said binder is polyethylacrylate.

12. A method of manufacturing electrodes of tungsten and a metal carbide for discharge lamps which comprises the steps of: providing a tungsten pin, coating near one end with a mixture comprising three substances: a first substance selected from the group consisting of powdered tantalum carbide, zirconium carbide, hafnium carbide, a mixture of carbon and tantalum, hafnium or zirconium in a gram atomic weight ratio of 1:1; a second substance which is a powdered metal chosen from the group consisting of elementary uranium, elementary thorium, and the oxides, borides, and carbides of uranium and thorium and a third substance which is a binder in a volatile diluent, said method further including evaporating said diluent, heating in an inert atmosphere by means of an electric arc discharge which starts at the end face of the tungsten pin near the coating and which is maintained for such a period of time that the end of the pin and the coating are melted and have assumed the shape of at least half a sphere, the quantity of said first and second sbstances being such that the fused top of the pin has a composition of 20–80% by weight of tungsten, 80–20% by weight of a metal carbide chosen from the group consisting of tantalum carbide, hafnium carbide and zirconium carbide, and 0–5% of a third substance, the quantity of said third substance being determined by weight in relation to the total weight of said tungsten and said metal carbide, said third substance being chosen from the group consisting of elementary thorium, elementary uranium and the oxides, borides and carbides of thorium and uranium.

13. A method as claimed in claim 12, wherein said coating mixture contains up to 5% (of said first substance) by weight of tungsten powder.

14. A method as claimed, in claim 12 said heating step is accomplished in a vertical discharge arc, the tungsten pin serving as a lower electrode.

15. An electrode which comprises: an envelope and at least two electrodes, each electrode including a head and a supporting pin, said head being at least a semispherical fused body 20–80% by weight of tungsten, 80–20% by weight of a metal carbide chosen from the group consisting of tantalum carbide, hafnium carbide and zirconium carbide, and 0–5% of a third substance, the quantity of said third substance being determined by weight in relation to the total weight of said tungsten and said metal carbide, said third substance being chosen from the group consisting of elementary thorium, elementary uranium, and the borides, carbides and oxides of thorium and uranium.

* * * * *